US006151712A

United States Patent [19]

Lampi

[11] Patent Number: 6,151,712

[45] Date of Patent: Nov. 28, 2000

[54] HAT

[76] Inventor: Michael D. Lampi, 2667 170$^{th}$ Ave. SE., Bellevue, Wash. 98008

[21] Appl. No.: 09/053,017

[22] Filed: Apr. 1, 1998

[51] Int. Cl.$^{7}$ ..... A61F 9/00

[52] U.S. Cl. ..... 2/10; 2/175.1; 2/182.1

[58] Field of Search ..... 2/10, 175.1, 175.4, 2/175.5, 195.1, 195.5, 195.6, 7, 171.01, 171.04, 181, 182.1, 200.1, 200.2, 209.3, 209.5, 416, DIG. 1

[56] References Cited

U.S. PATENT DOCUMENTS 276,753 5/1883 Bartine ..... 2/175.4
591,311 10/1897 Watson et al. ..... 2/171.04
1,187,507 6/1916 Coyne ..... 2/175.5
2,880,423 4/1959 O'Reilly ..... 2/171.04
5,271,099 12/1993 Lin ..... 2/10

*Primary Examiner*—Bibhu Mohanty
*Attorney, Agent, or Firm*—Jansson, Shupe, Bridge & Munger, Ltd.

[57] ABSTRACT

A hat is provided to protect a wearer's head from the elements. The hat includes a head receiving structure having an inner surface defining a head receipt cavity. An upper brim is positioned over a first end of the head receiving structure, and a lower brim extends radially from a second, opposite end of the head receiving structure.

45 Claims, 3 Drawing Sheets

FIG. 5
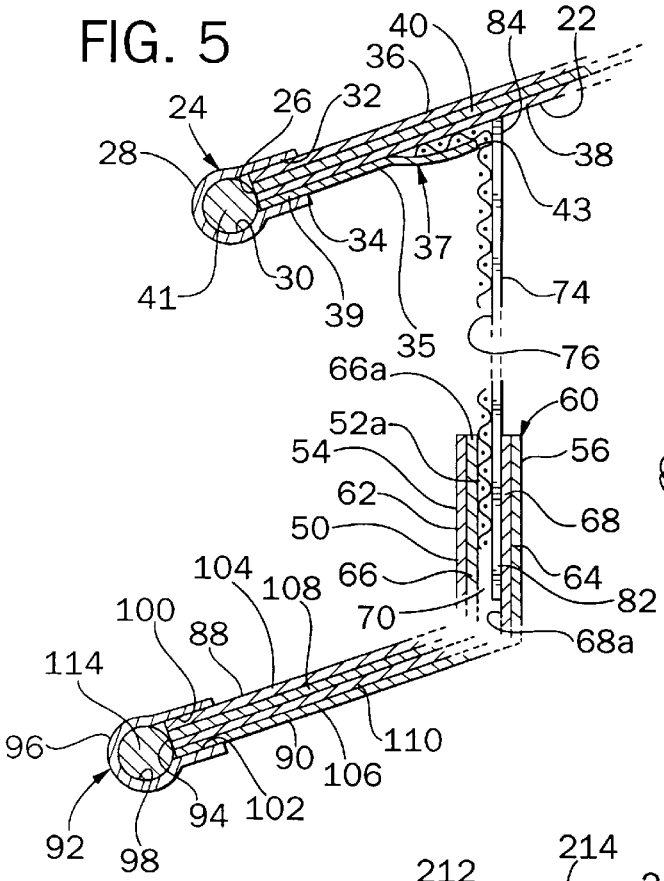
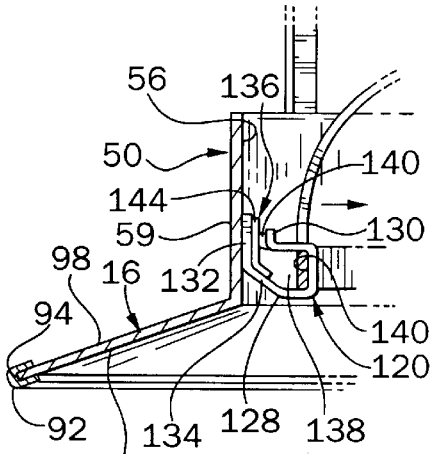
FIG. 6
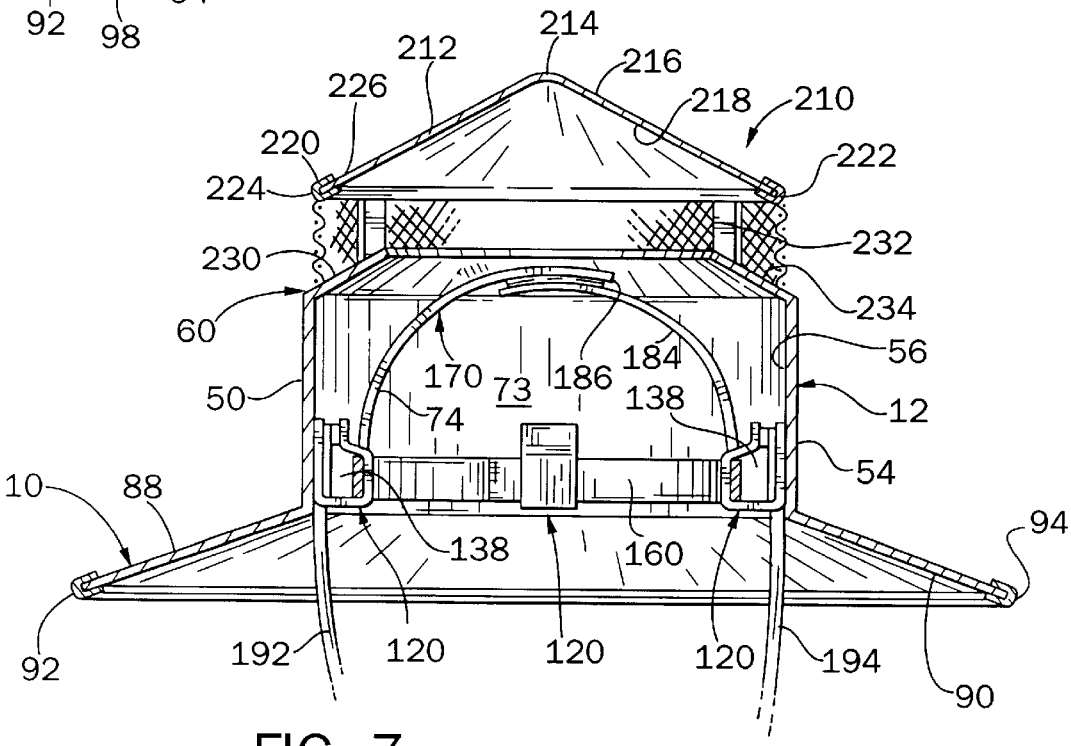
FIG. 7

HAT

BACKGROUND AND SUMMARY OF THE INVENTION

This invention relates to clothing, and in particular, to a hat that protects a wearer's head from the elements.

Individuals typically wear a hat on their head for a variety of reasons from fashion to protection. For example, in order to protect the head of a wearer from the sun, a baseball cap or the like is often worn. However, the inner surface of the cap engages the head of a wearer, thereby causing perspiration. This, in turn, may cause great discomfort for the wearer of the cap.

On the other hand, an individual will often times wear a hat on their head in order to protect their head from the elements such as rain, sleet and snow. While prior art hats provide limited protection, most prior art hats are not designed for prolonged exposure to snow or rain. Therefore, when exposed to such elements, most prior art hats succumb and become wet and/or damaged. Therefore, these prior art hats provide little or no protection for the wearer.

Therefore, it is a primary object and feature of the present invention to provide a hat for an individual which provides protection from the elements for the wearer.

It is a further object and feature of the present invention to provide a hat with increased air flow therein in order to encourage high volume convective cooling of the head of the wearer.

It is still a further object and feature of the present invention to provide a hat which reduces the instances of water collection therein.

In accordance with the present invention, a hat is provided. The hat includes a head receiving structure having an inner surface defining a head receipt cavity. The head receiving structure also includes first and second opposite ends. An upper brim having an outer edge is positioned over the first end of the head receiving structure. A lower brim extends radially from the second end of the head receiving structure.

The hat of the present invention also includes a head support structure interconnected to the inner surface of the head receiving structure. The head support structure includes a plurality of adjustable support bands interconnected to and spaced about the inner surface of the head receiving structure. Each adjustable support band defines a passageway therethrough. A head strap extends through the passageway of each adjustable head band. The head strap has first and second opposite ends interconnected by an adjustable connector. The adjustable connector selectively interconnects the first and second ends of the head strap at a plurality of predetermined locations in order to vary the length of the head strap.

A head spacer element is interconnected to the head strap. The head spacer element includes first and second straps. Each strap of the head spacer element includes a first end interconnected to the head strap. A connector selectively interconnects the second end of the first strap of the head spacer element to the second end of the second strap of the head spacer element at a plurality of predetermined locations to vary the length of the head spacer element.

The head receiving structure of the hat of the present invention includes a generally tubular solid portion and a generally tubular mesh portion. The solid portion includes a first outer layer constructed from a waterproof material, a second inner layer constructed from a waterproof material, and a first intermediate layer captured therebetween. The first intermediate layer of the solid portion of the head receiving structure is constructed from a thermal reflective material. The solid portion of the head receiving structure may include a second intermediate layer constructed from a thermal absorptive material.

The upper brim of the hat includes a first outer layer constructed from a waterproof material, a second inner layer constructed from a waterproof material, and an intermediate layer captured therebetween. The intermediate layer of the upper brim of the hat is constructed from a thermal reflective material.

Similarly, the lower brim of the hat includes a first outer layer constructed from a waterproof material, a second inner layer constructed from a waterproof material, and an intermediate layer captured therebetween. An intermediate layer of the lower brim hat is constructed from a thermal reflective material. In addition, a second intermediate layer positioned between the first intermediate layer and the inner layer of the lower brim may also be provided. The second intermediate layer is constructed from a thermal absorptive material.

In accordance with a still further aspect of the present invention, a hat is provided having a tubular head receiving structure. The head receiving structure includes an inner surface defining a head receipt cavity. The head receipt structure has first and second opposite ends. An upper brim is positioned over the first end of the head receiving structure and has an outer edge. The upper brim includes a first outer layer constructed from a waterproof material, a second inner layer constructed from a waterproof material, and an intermediate layer captured between the inner and outer layers of the upper brim.

The hat of the present invention further includes a lower brim extending radially from the second end of the head receiving structure. The lower brim also includes a first outer layer constructed from a waterproof material, a second inner layer constructed from a waterproof material, and a first intermediate layer captured between the inner and outer layers of the brim. The lower brim may also include a second intermediate layer captured between the first intermediate layer and the inner layer. The second intermediate layer of the lower brim of the hat is constructed from a thermal absorptive material.

The head receiving structure of the hat of the present invention includes a first outer layer constructed from a waterproof material, a second inner layer constructed from a waterproof material, and a first intermediate layer captured between inner and outer layers of the head receiving structure. The head receiving structure may include a second intermediate layer captured between the first intermediate layer and the inner layer.

Various other features, objects and advantages of the invention will be made apparent from the following description taken together with the drawings.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings:

FIG. 5 is an enlarged, cross-sectional view showing a portion of the hat of the present invention;

FIG. 6 is an enlarged, cross-sectional view showing a portion of the hat of FIG. 3; and FIG. 7 is a cross-sectional view of a second embodiment of a hat in accordance with the present invention.

DESCRIPTION OF THE ILLUSTRATED EMBODIMENT

Figure 1:
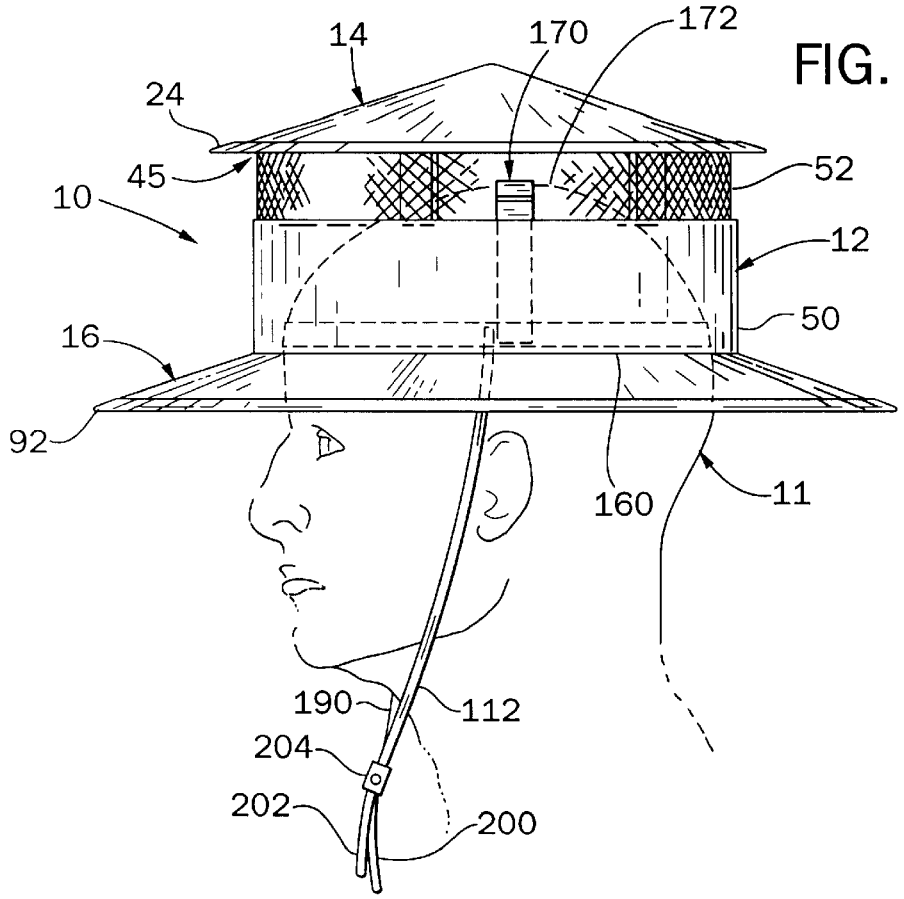
FIG. 1 is a side elevational view of a hat in accordance with the present invention, supported on the head of a wearer.

Referring to FIG. 1, a hat in accordance with the present invention is generally designated by the referrence numeral 10. It is contemplated that hat 10 be placed on top of the head 11 of a wearer.

Hat 10 includes a generally cylindrical head receiving structure 12 having an upper brim 14 mounted to a first end thereof and a lower brim 16 mounted to a second, opposite end thereof. Head receiving structure 12 of hat 10 is generally cylindrical in shape, however, it is contemplated that head receiving structure 12 be generally conical in shape having a truncated upper end which interconnects to the underside of upper brim 14.

Figure 3:
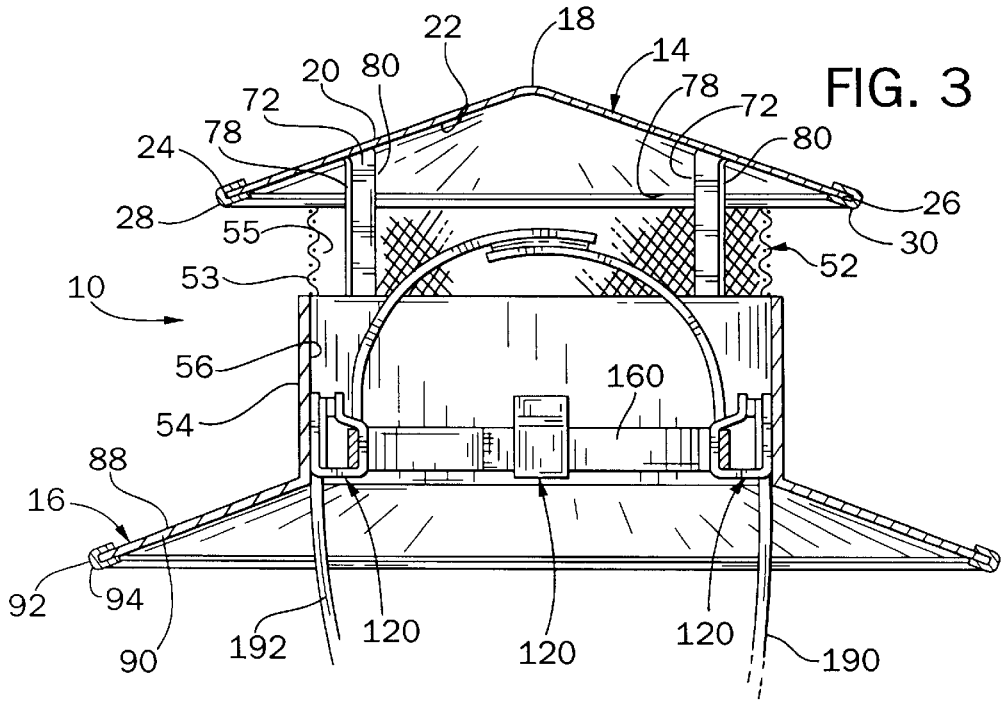
FIG. 3 is a cross-sectional view taken along line 3—3 of FIG. 2.

As best seen in FIG. 3, upper brim 14 is generally conical in shape and includes an apex 18 having an upper surface 20 extending radially therefrom. Upper brim 14 further includes a lower surface 22 which is directed toward the interior of head receiving cavity 23 within head receiving structure 12 of hat 10. A generally C-shaped edge protector 24 overlaps the radially outer edge 26 of upper brim 14. Edge protector 24 includes an outer surface 28 and an inner surface 30. A first portion 32 of inner surface 30 of edge protector 24 is affixed to the outer surface 20 of upper brim 14 by means of thread, glue, or other manner customary in the trade. A second portion 34 of inner surface 30 of edge protector 24 may be affixed to the lower surface 22 of upper brim 14 by means of thread, glue, or other manner customary in trade.

Figure 4:
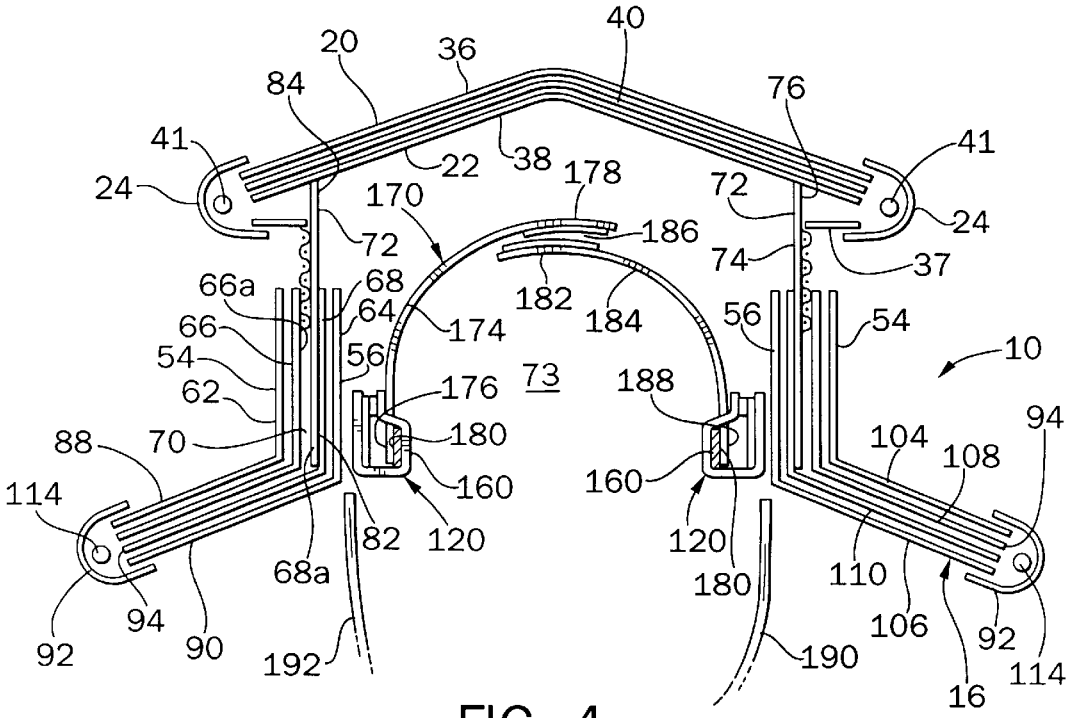
FIG. 4 is a schematic view of the hat of the present invention, partially in section, showing the layers of material from which the hat is constructed.

In the alternative, the second portion 34 of inner surface 30 of edge protector 24 may be affixed to lower surface 35 of an eave 37, FIG. 4. Eave 37 includes a generally outer edge 39 which is captured within inner surface 30 of edge protector 24 and a radially inner edge 43 which is interconnected to the first end of head receiving structure 12.

It is contemplated to construct upper brim 14 from a plurality of layers of different material in order to increase the protective characteristics of hat 10. As best seen in FIG. 4, upper brim 14 include an outer layer 36 constructed from a waterproof material, and an inner layer constructed from a thermal absorptive material. A thermal reflective layer 40 is captured between outer layer 36 and inner layer 38.

In operation, outer layer 36 of upper brim 14 prevents water from seeping through upper brim 14 into head receiving cavity 23. As a result, rain or snow which engages upper surface 20 of outer layer 36 of upper brim 14 is directed downwardly along upper surface 20 and off upper brim 14. Intermediate layer 40 is constructed from a thermally reflective material in order to reduce the effects of solar radiation that would otherwise be absorbed by hat 10 or by the wearer thereof. Inner layer 38 is constructed from a thermally absorptive material in order to reduce the amount of thermal and ultraviolet radiation reflected by the inner surface 22 of upper brim 14 toward the interior of hat 10.

In order to stabilize the structure of upper brim 14, a wire 41 may be placed adjacent radially outer edge 26 of upper brim 14. In the preferred construction, wire 41 is captured within the inner surface 30 of edge protector 24. Wire 41 may be constructed from a rigid material such as plastic in order to maintain the generally circular configuration of outer edge 26 of upper brim 14. In the alternative, wire 41 may be constructed from a more pliable material such as metal so as to allow a wearer the ability to manipulate the shape of upper brim 14 to a desired configuration.

Upper brim 14 is supported above a first end 45 of generally cylindrical head receiving structure 12 of hat 10. Head receiving structure 12 includes a first solid portion 50 and a second mesh portion 52 extending vertically therefrom. Solid portion 50 is defined by a vertical outer surface 54 and a vertical inner surface 56. As best seen in FIGS. 3 and 4, inner surface 56 partially defines head receipt cavity 23 within hat 10.

It is contemplated that solid portion 50 of head receiving portion 12 be constructed from a plurality of differing materials in order to increase the protective characteristics of hat 10. Solid portion 50 of head receiving structure 12 includes an outer layer 62 constructed from a waterproof material, and an inner layer 64 also constructed from a waterproof material. An intermediate layer 66 is positioned between outer layer 62 and inner layer 64 and abuts outer layer 62. It is contemplated that intermediate layer 66 be constructed from a thermal reflective material in order to reduce the effects of solar radiation that would otherwise be absorbed by the hat 10 or by the wearer thereof. Solid portion 50 further includes a second intermediate layer 68 positioned between first intermediate layer 66 and inner layer 64. Second intermediate layer 68 is constructed from a thermal absorptive material in order to reduce the amount thermal and ultraviolet radiation reflected by the inner surface 56 of head receiving structure 12 toward the interior of hat 10.

A plurality of circumferentially spaced vertical support receiving pockets 70 are formed in solid portion 50 of hat 10. Each support receiving pocket 70 is defined by a portion of inner surface 66*a* of first intermediate layer 66 and a portion of outer surface 68*a* of second intermediate layer 68.

Head receiving structure 12 further includes a plurality of vertical supports 72 receivable within corresponding pockets 70 formed within head receiving structure 12. Each vertical support 72 includes inner and outer surfaces 74 and 76, respectively, and first and second side edges 78 and 80, respectively. A first end 82 of each vertical support 72 is received within corresponding pocket 70 formed in head receiving structure 12. A second, upper end 84 of each vertical support 72 abuts the inner surface 22 of upper brim 14. Vertical supports 72 maintain the spacing between upper brim 14 and lower brim 16 and keep the outer surfaces 54 and of solid portion 50 and mesh portion 52, respectively, of head receipt structure 12 taut.

As best seen in FIG. 5, a lower end 52*a* of mesh portion 52 is captured between inner surface 66*a* of intermediate layer 66 and outer surface 68*a* of second intermediate layer 68 of solid portion 50 of head receiving structure 12. The upper portion 52*b* of mesh portion 52 is captured between eave 37 and lower surface 22 of upper brim 14. Mesh portion 52 includes an outer surface 53 and an inner surface 55 which partially defines head receipt cavity 23 within head receiving structure 12 of headgear 10. It is contemplated to provide mesh portion 52 with a plurality of apertures therethrough. In the preferred environment, each aperture has a direction of approximately 0.04 inches by 0.04 inches. Mesh portion 52 has a material thickness of less than 0.01 inches in order to minimize the air flow attenuation through mesh portion of headwear 10, and in order to reduce the likelihood of foreign objects penetrating the mesh portion 52 of hat 10.

A disc-shaped lower brim 16 is integral with and extends radially from head receiving structure 12. Lower brim 16 includes an upper surface 88 and a lower surface 90. A general C-shaped edge protector 92 overlaps the radially outer edge 94 of lower brim 16. Edge protector includes an outer surface 96 and an inner surface 98. The first portion 100 of inner surface 98 of edge protector 92 is affixed to the upper surface 88 of lower brim 16 by means of thread, glue, or other manner customary in the trade. A second portion 102 of inner surface 98 of edge protector 92 may be affixed to the lower surface 90 of lower brim 16 by means of thread, glue or other manner customary in the trade.

It is contemplated to construct lower brim 16 from a plurality of layers of different material in order to increase the protective characteristics of hat 10. Lower brim 16 includes an outer layer 104 constructed from a waterproof material. It is contemplated that outer layer 104 of lower brim 16 be integral with outer layer 62 of head receiving structure 12. Lower brim further includes an inner layer 106 constructed from a waterproof material. It is contemplated that inner layer 106 of lower brim 16 formed integral with inner layer 64 of head receiving structure 12. A first intermediate layer 108 is positioned adjacent outer layer 104 of lower brim 16 and is constructed from a thermal reflective material. It is contemplated that first intermediate layer 108 of lower brim 16 be formed integral with intermediate layer 66 of head receiving structure 12. A second intermediate layer 110 is constructed from a thermal absorptive material and is positioned between first intermediate layer 108 and inner layer 106 of lower brim 16. It is contemplated that second intermediate layer 110 be formed integral with second intermediate layer 68 of head receiving section 12.

Outer layer 104 of lower brim 16 prevents water from seeping through lower brim 16 onto the neck of the wearer of hat 10. As a result, rain or snow which engages the upper surface 88 of outer layer 104 of lower brim 16 is directed downwardly along upper surface 88 and off lower brim 16. First intermediate layer 108 of lower brim 16 is constructed from a thermally reflective material in order to reduce the effects of solar radiation that would otherwise be absorbed by hat 10 or by the wearer thereof. Second intermediate layer 110 is constructed from a thermal absorptive material in order to reduce the amount of thermal and ultra violet radiation reflective by lower surface 90 of the lower brim 16 toward the wearer of hat 10. Finally, the inner layer 106 of lower brim 16 is constructed from a waterproof material so as to prevent first and second intermediate layers 108 and 110, respectively, from absorbing moisture thereby damaging hat 10.

In order to stabilize lower brim 16 of hat 10, a wire 114 may be placed adjacent the outer edge 94 of lower brim 16. Wire 114 is captured within the inner surface 98 of edge protector 92. Wire 114 may be constructed from a rigid material such as plastic in order to maintain the generally circular configuration of outer edge 94 of lower brim 16. In the alternative, wire 114 may be constructed from a more pliable material such as metal so as to allow the wearer the ability to manipulate the shape of the lower brim 16 to a desired configuration.

Hat 10 further includes a plurality of adjustable support bands 120 circumferentially spaced about and interconnected to inner surface 56 of solid portion 50. In the disclosed embodiment, a portion 122 of the inner surface 56 of solid portion 50 on the forward end 124 of hat 10 is free of any adjustable support bands 120. In addition, the support bands 120*a* and 120*b* are positioned so as to align with the temples of a wearer of hat 10.

As best seen in FIG. 6, each adjustable support band 120 includes a flexible strap 128 having first and second opposite ends 130 and 132, respectively. A portion of the outer surface 134 of strap 128 is affixed to the inner surface 56 of solid portion 50 by means of thread, glue, or other manner customary in the trade. A hook and pile connector 136 interconnects first end 130 of strap 128 to second end 132 of strap 128 such that strap 128 defines a passageway 138 therethrough. Hook portion 140 of hook and pile connector 136 is interconnected to the inner surface 142 of strap 128 at a location adjacent first end 130. A pile pad 144 is affixed to the inner surface 142 of strap 128 at a location adjacent second end 132. The diameter of passageway 138 defined by strap 128 may be adjusted by varying the location at which hook portion 140 is interconnected to pile pad 144.

Figure 2:
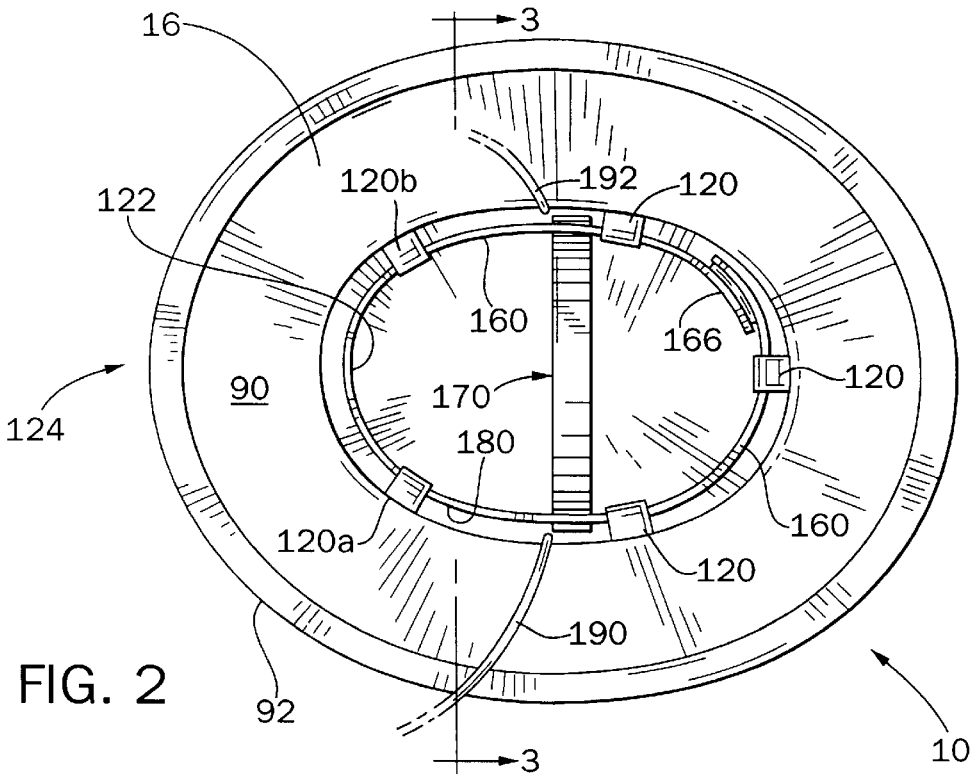
FIG. 2 is a bottom plan view of the hat of the present invention.

A head strap 160 extends through each passageway 138 defined by each adjustable support band 120. As best seen in FIG. 2, head strap 160 includes first and second opposite ends 162 and 164, respectively, which are interconnected by a hook and pile connector 166. As such, the length of head strap 160 may be adjusted to fit the head 11 of the wearer.

A head spacer element 170 is interconnected to head strap 160 in order to space the upper surface 172 of wearer's head 11 from the inner surface 22 of upper brim 14. Head spacer element 170 includes a first strap 174 having first and second opposite ends 176 and 178. First end 176 of first strap 174 is interconnected to the outer surface 180 of head strap 160. The second end 178 of first strap 174 is interconnected to a second end 182 of second strap 184 of head spacing element 170 by a hook and pile connector 186. A second end 188 of second strap 184 of head spacer element 170 is also connected to the outer surface 180 of head strap 160 at a location spaced from first end 176 of strap 174.

Hat 10 may also include first and second draw strings 190 and 192, respectively. Draw strings 190 and 192 have corresponding first ends 194 and 196, respectively, interconnected to inner surface 56 of solid portion 50 of head receiving structure 12. Draw strings 190 and 192 also include corresponding second ends 200 and 202, respectively. Second ends 200 and 202 of draw strings 190 and 192, respectively, extend through an adjustable connector 204 which allows a wearer to adjust the length of draw strings 190 and 192 in a conventional manner.

Referring to FIG. 7, an alternate hat 210 in accordance with the present invention is shown. With the exception of the upper brim and the inner brim, the hat disclosed in FIG. 7 is identical to that previously described, and hence, the previous description of hat 10 will be understood to apply to hat 210, FIG. 7, with common reference characters being used.

Hat 210 includes an upper brim 212 mounted to a first end of generally cylindrical head receiving structure 12. Upper brim 212 is generally conical in shape and includes an apex 214 having upper surface 216 extending radially therefrom. Upper brim 212 also includes a lower surface 218 which is directed toward the interior of head receiving cavity 23 within head receiving structure 12 of hat 210.

A generally C-shaped edge protector 220 overlaps the radially outer edge 222 of the brim 210. Each protector 220 includes an outer surface 224 and an inner surface 226. A first portion of the inner surface 226 of edge protector 220 is affixed to the upper surface 216 of upper brim 210 by means of thread, glue, or other manner customary in the trade. A second portion of inner surface 226 of edge protector 220 may be affixed to the lower surface 218 of upper brim 210 by means of thread, glue, or other means that are customary in the trade.

An inner brim 230 extends radially inwardly from first end 60 of solid portion 50 of head supporting structure 12. Inner brim includes an radially inner edge 232 which defines an opening therein. Inner brim 230 includes an upper surface 234 which slopes downwardly from inner edge 232 to the first end 60 of solid portion 50 of head receiving structure 12. Upper surface 234 of inner brim 230 directs water or snow which engage the upper surface 234 of upper brim 230 downwardly away from head receiving cavity 23 within hat 210.

Various modes of carrying out the invention are contemplated as being within the scope of the following claims particularly pointing out and distinctly claiming the subject matter which is regarded as the invention.

I claim:

1. A hat, comprising:

a head receiving structure including an inner surface defining a head receipt cavity, the head receiving structure having first and second opposite ends;

an upper brim positioned over the first end of the head receiving structure and having an outer edge radially spaced from the first end thereof;

a lower brim extending radially from the second end of the head receiving structure and having an outer edge; and a head support structure interconnected to the inner surface of the head receiving structure, the head support structure including a plurality of adjustable support bands interconnected to and spaced about the inner surface of the head receiving structure.

2. The hat of claim 1 wherein each adjustable support band defines a passageway therethrough.

3. The hat of claim 2 further comprising a head strap extending through the passageway of each adjustable band, the head strap having first and second opposite ends.

4. The hat of claim 3 further comprising an adjustable connector for selectively interconnecting the first and second ends of the head strap at a plurality of predetermined locations to vary the length of the head strap.

5. The hat of claim 3 further comprising a head spacer element interconnected to the head strap, the head spacer element including first and second straps.

6. The hat of claim 5 wherein the first strap of the head spacer element includes a first end interconnected to the head strap, and wherein the second strap of the head spacer element includes a first end interconnected to the head strap.

7. The hat of claim 6 further comprising a connector for selectively interconnecting a second end of the first strap of the head spacer element to a second end of the second strap of the head spacer element at a plurality of predetermined locations to vary the length of the head spacer element.

8. A hat, comprising:

a tubular, head receiving structure including an inner surface defining a head receipt cavity, the head receiving structure having first and second opposite ends; and an upper brim positioned over the first end of the head receiving structure and having a radially outer edge, the upper brim including a first outer layer constructed from a waterproof material, a second inner layer constructed from a waterproof material, and an intermediate layer captured between the inner and outer layers of the upper brim; and a wire interconnected to the outer edge of the upper brim.

9. The hat of claim 8 wherein the first outer layer of the solid portion of the head receiving structure is constructed from a waterproof material.

10. The hat of claim 9 wherein the solid portion of the head receiving structure includes a second inner layer.

11. The hat of claim 10 wherein the second inner layer of the solid portion of the head receiving structure is constructed from a waterproof material.

12. The hat of claim 11 wherein the solid portion of the head receiving structure includes a first intermediate layer adjacent the outer layer.

13. The hat of claim 12 wherein the first intermediate layer of the solid portion of the head receiving structure is constructed from a thermal reflective material.

14. The hat of claim 13 wherein the solid portion of the head receiving structure includes a second intermediate layer.

15. The hat of claim 14 wherein the second intermediate layer of the solid portion of the head receiving structure is constructed from a thermal absorptive material.

16. The hat of claim 1 further comprising a wire interconnected to the outer edge of the lower brim.

17. A hat, comprising:

a head receiving structure including an inner surface defining a head receipt cavity, the head receiving structure being generally cylindrical in shape having first and second opposite ends;

an upper brim positioned over the first end of the head receiving structure and having an outer edge radially spaced from the first end thereof; and a lower brim extending circumferentially about and radially from the second end of the head receiving structure and having an outer edge.

18. A hat, comprising:

a head receiving structure including an inner surface defining a head receipt cavity, the head receiving structure having first and second opposite ends and including a generally tubular solid portion and a generally tubular mesh portion;

an upper brim positioned over the first end of the head receiving structure and having an outer edge radially spaced from the first end thereof; and a lower brim extending radially from the second end of the head receiving structure and having an outer edge.

19. A hat, comprising:

a head receiving structure including an inner surface defining a head receipt cavity, the head receiving structure having first and second opposite ends;

an upper brim positioned over the first end of the head receiving structure and having an outer edge radially spaced from the first end thereof; the upper brim including a first outer layer being constructed from a waterproof material; and a lower brim extending circumferentially about and radially from the second end of the head receiving structure and having an outer edge.

20. A hat, comprising:

a head receiving structure including an inner surface defining a head receipt cavity, the head receiving structure having first and second opposite ends;

an upper brim positioned over the first end of the head receiving structure and having an outer edge radially spaced from the first end thereof; and a lower brim extending circumferentially about and radially from the second end of the head receiving structure and having an outer edge, the lower brim includes a first outer layer being constructed from a waterproof material.

21. The hat of claim 18 wherein the solid portion of the head receiving structure includes a first outer layer.

22. A hat, comprising:

a head receiving structure including an inner surface defining a head receipt cavity, the head receiving structure being generally cylindrical in shape having first and second opposite ends;

an upper brim positioned over the first end of the head receiving structure and having an outer edge radially spaced from the first end thereof;

a lower brim extending radially from the second end of the head receiving structure and having an outer edge; and a wire extending circumferentially about and interconnected to the outer edge of the upper brim.

23. A hat, comprising:

a head receiving structure including an inner surface defining a head receipt cavity, the head receiving structure having first and second opposite ends;

an upper brim positioned over the first end of the head receiving structure and having an outer edge radially spaced from the first end thereof, the upper brim including a first outer layer being constructed from a waterproof material and a second inner layer; and a lower brim extending radially from the second end of the head receiving structure and having an outer edge.

24. A hat, comprising:

a head receiving structure including an inner surface defining a head receipt cavity, the head receiving structure having first and second opposite ends;

an upper brim positioned over the first end of the head receiving structure and having an outer edge radially spaced from the first end thereof; and a lower brim extending radially from the second end of the head receiving structure and having an outer edge, the lower brim including a first outer layer being constructed from a waterproof material and a second inner layer.

25. The hat of claim 22 wherein the second inner layer of the upper brim is constructed from a waterproof material.

26. The hat of claim 25 wherein the upper brim includes an intermediate layer captured between the inner and outer layers of the upper brim.

27. The hat of claim 26 wherein the intermediate layer of the upper brim of the hat is constructed from a thermal reflective material.

28. The hat of claim 23 wherein the second inner layer of the lower brim of the hat is constructed from a waterproof material.

29. The hat of claim 28 wherein lower brim includes a first intermediate layer adjacent the outer layer.

30. The hat of claim 29 wherein the first intermediate layer of the lower brim of the hat is constructed from a thermal reflective material.

31. The hat of claim 30 wherein the lower brim includes a second intermediate layer.

32. The hat of claim 31 wherein the second intermediate layer of the lower brim of the hat is constructed from a thermal absorptive material.

33. A hat, comprising:

a tubular, head receiving structure including an inner surface defining a head receipt cavity, the head receiving structure having first and second opposite ends; and an upper brim positioned over the first end of the head receiving structure and having an outer edge, the upper brim including a first outer layer constructed from a waterproof material, a second inner layer constructed from a waterproof material, and an intermediate layer constructed from a thermal reflective material captured between the inner and outer layers of the upper brim.

34. The hat of claim 33 wherein the upper brim includes a radially outer edge.

35. The hat of claim 24 further comprising a lower brim extending radially from the second end of the head receiving structure and having a radially outer edge.

36. The hat of claim 35 further comprising a wire interconnected to the outer edge of the lower brim.

37. The hat of claim 35 wherein the lower brim includes a first outer layer constructed from a waterproof material, a second inner layer constructed from a waterproof material, and a first intermediate layer captured between the inner and outer layers of the upper brim.

38. The hat of claim 37 wherein the first intermediate layer of the lower brim of the hat is constructed from a thermal reflective material.

39. The hat of claim 38 wherein the lower brim includes a second intermediate layer captured between the first intermediate layer and the inner layer.

40. The hat of claim 39 wherein the second intermediate layer of the lower brim of the hat is constructed from a thermal absorptive material.

41. The hat of claim 37 wherein the head receiving structure includes a first outer layer constructed from a waterproof material, a second inner layer constructed from a waterproof material, and a first intermediate layer captured between the inner and outer layers of the head receiving portion.

42. The hat of claim 41 wherein the first intermediate layer of the head receiving structure is constructed from a thermal reflective material.

43. The hat of claim 42 wherein the head receiving structure includes a second intermediate layer captured between the first intermediate layer and the inner layer.

44. The hat of claim 43 wherein the second intermediate layer of the head receiving portion is constructed from a thermal absorptive material.

45. The hat of claim 33 further comprising an inner brim, the inner brim interconnected to the inner surface on the head receiving structure and extending into the head receipt cavity.

* * * * *